US005378082A

United States Patent [19]

Hiller et al.

[11] Patent Number: 5,378,082

[45] Date of Patent: Jan. 3, 1995

[54] SHIP LIFTING INSTALLATION

[76] Inventors: Manfred Hiller, Ilvericher Str. 13, D-4150 Krefeld-Stratum; Norbert Umlauf, Haferkamp 64, D-5800 Hagen 1, both of Germany

[21] Appl. No.: 202,851

[22] Filed: Feb. 25, 1994

Related U.S. Application Data

[63] Continuation-in-part of Ser. No. 140,719, Oct. 21, 1993, abandoned, which is a continuation of Ser. No. 777,566, Dec. 31, 1991, abandoned.

[30] Foreign Application Priority Data

Mar. 27, 1990 [DE] Germany ..... 4009744

[51] Int. Cl.[6] ..... B63C 3/06

[52] U.S. Cl. ..... 405/3; 405/1

[58] Field of Search ..... 405/1, 3, 4; 114/44, 114/45, 48; 414/678

[56] References Cited

U.S. PATENT DOCUMENTS

| | | | |
|---|---|---|---|
| 3,777,691 | 12/1973 | Beale | 114/48 |
| 4,161,126 | 7/1979 | Winzeler | 74/674 |
| 4,329,082 | 5/1982 | Gillis | 405/3 |
| 4,686,920 | 8/1987 | Thomas | 405/3 |
| 4,763,592 | 8/1988 | Russ | 114/45 |
| 5,020,463 | 6/1991 | Franklin et al. | 405/3 X |
| 5,051,027 | 9/1991 | Horton | 405/3 |

FOREIGN PATENT DOCUMENTS 2132142 1/1973 Germany .

*Primary Examiner*—David H. Corbin

*Attorney, Agent, or Firm*—Anderson Kill Olick & Oshinsky

[57] ABSTRACT

A ship lifting installation (1) comprises a platform (3) for docking ships (2), which platform (3) can be lifted and lowered by means of lifting mechanisms (13). Mass-production lifting mechanisms (13) comprising a grooved cable drum (16) with a planetary gear unit located in the cable drum (16) are used in the ship lifting installation (1) and are provided with an electric motor (27) having an integrated brake, at least one upper cable pulley block (14) which is arranged separately from the cable drum (16) on a cable pulley support (20), and at least one lower cable pulley block (15) which is built into the platform (3).

10 Claims, 4 Drawing Sheets

SHIP LIFTING INSTALLATION

This is a continuation-in-part application of Ser. No. 08/140,719 filed Oct. 21, 1993, now abandoned, which is a continuation application of Ser. No. 07/777,556 filed Dec. 31, 1991 (now abandoned).

FIELD OF THE INVENTION

The invention is directed to a ship lifting installation which comprises a platform for docking ships and can be lifted and lowered by lifting mechanisms.

BACKGROUND OF THE INVENTION

Such ship lifting installations, which have been known for approximately thirty years, are used primarily as an alternative, for e.g. dry and floating docks, in commercial ship repair and construction yards for very large lifting capacities, preferably in the range of approximately 1,000 to 10,000 t. The known ship lifting installations substantially comprise a steel platform with supports for a ship to be docked and lifting mechanisms which are arranged on a pier at two opposite sides and connected with the platform via supporting means. Electrical hoists with spur gear units and cables as supporting means, hydraulic hoists with planetary gear units and cables as supporting means, hydraulic step hoists which are operated in a discontinuous manner and likewise comprise cables as supporting means, and hydraulic lifting mechanisms with either link conveyors or chains as supporting means, are all used as lifting mechanisms.

Approximately 90% of all ship lifting installations are outfitted with electromechanical hoists. The hoists are special constructions designed according to the respective requirements, which are determined in particular by the carrying load, and accordingly cannot be produced in standardized series. Apart from the high manufacturing costs involved and the very high expenditure of material, these hoists also take up a great deal of space because of their wide frame construction which is essential to their construction and is also brought about by the use of spur gear units or open gearing steps. A large amount of space is synonymous with very great weight, a wide installation surface and a correspondingly wide pier; and the wider the pier, the greater the foundation, i.e. the concrete pier.

Finally, ship lifting installations with lifting capacities under 500 t - including small installations of 10 to 15 t - are known, for e.g. medium-size dockyards and for the maritime leisure industry, i.e. in yacht clubs and marinas with limited dock weights. The lifting installations used in the latter are swinging cranes and especially movable gantries known as mobile or travel lifts. In principle, the travel lift is a large, movable steel frame which is outfitted with lifting mechanisms and supporting belts. In order to dock ships, the travel lift must move on two concrete piers which are arranged parallel to one another and grounded on steel piles. After lowering the supporting belts, the ship is maneuvered between the two piers and lifted via the supporting belts connected with the lifting mechanisms. A problem consists in correctly placing the belts and operating the lift. Trained personnel are required for both operations. Apart from the fact that the belts wear out very quickly, an extremely large construction cost is required in the travel lift because a continuous pile foundation is necessary since the wheels of the travel lift claim the entire pier as traveling load. Further, the travel lift requires a great deal of space because of its dimensions. Its maneuverability is limited and, in many cases, it cannot move into halls or hangars for this reason. It is then necessary to transfer the ship, i.e. additional investments are required for a boat trailer or floor-mounted cranes for transferring the ship.

In principle, the known swinging crane, used for lifting and lowering is a rotatable steel tower with a jib arm, a cable pulley block with hook-type bottom block being arranged at the front end of the latter. A frame with supporting belts is fastened in turn to the latter. In order to dock, the crane jib is swiveled over the water and the ship is moved over the supporting belts. Operation of the swinging crane is simpler than operating a travel lift, but the same set of problems is posed by placement and wear of the belts.

It is the object of the invention to simplify a ship lifting installation of the type mentioned in the beginning, to standardize the lifting means for lifting and lowering the platform, particularly with respect to the construction and number, and construct them in such a way that they can be used especially in the area of small dock installations with lifting capacities below 500 t, without the aforementioned disadvantages and in an environmentally sound manner.

SUMMARY OF THE INVENTION

This object is met according to the invention in that mass-production lifting mechanisms, which comprise a grooved cable drum with a planetary gear unit located in the cable drum, are used and are provided with a mass-production brake motor, i.e. an electric motor comprising an integrated brake, at least one upper cable pulley block arranged separately from the cable drum on a cable pulley support and at least one lower cable pulley block built into the platform.

Accordingly, the invention takes a path which completely diverges from the technology used for decades in the area of small docks. This path is based on an understanding, achieved from an open-minded consideration of the numerous technical possibilities, that with the use of mass-production lifting mechanisms, known for a long time in crane construction, not only can overcome the described considerable disadvantages of the swinging crane or gantries previously used in small docking installations be avoided, but more advantages also can be gained. Lifting belts can be dispensed with entirely and construction costs can be considerably reduced since continuous pile foundations are no longer required. This is particularly true when two lifting mechanisms, in lifting mechanism frames anchored with the foundation of a pier, are advantageously arranged at the two longitudinal sides of the platform, respectively, as in the case of the small docking installation preferred within the framework of the present invention. Accordingly, only the front and rear ends of the pier are loaded, so that only four pile groups are required. The mass-production lifting mechanisms, which are exposed to identical carrying loads and are constructed moreover so as to be very narrow, occupy considerably less space in width, so that additional savings result with respect to space and costs in the pier in this manner.

The mass-production lifting mechanism is distinguished by an extraordinary multiplicity of variants, allowing a modular building block system which makes it possible to vary existing mutually adapted components in any manner desired and to adapt them to every requirement profile without special construction. In addition, the mass-production lifting mechanisms possess a particularly closely graduated series of loads so that virtually any desired demand for lifting power can be satisfied, possibly in combination with different cable reeving (number of cable strands). The lifting mechanism, which is provided with at least one upper and one lower cable pulley block, can be considerably expanded, with respect to its carrying load, merely by adding cable pulleys; it is possible to form a pulley block with a maximum of eight cable strands.

The lifting mechanism requires only limited maintenance, has a long service life and can be prepared very quickly as a result of the standardized construction. Replacement parts can be provided quickly and possibly even directly from the warehouse as a result of the series production and the standardized construction. The brake motor, which is flanged on subsequently and is likewise available as a mass-produced structural component part, contributes to the user-friendliness to an extraordinary degree because, in contrast to the diesel, hydraulically driven lifting and moving mechanisms used in travel lifts, it requires considerably less expenditure on replacement parts and maintenance. In addition, its operation is substantially more reliable than that of trouble-prone hydraulic systems (leakage, temperature, soiling).

When the platform is provided with an integrated transporting system, maintenance and/or repair to a ship docked on the transporting system can be carried out away from the platform by means of shunting and/or transporting this system to the desired location.

The transporting system can comprise a shunting or transporting path or surface of the platform lift. The platform lift is the docking platform for the ship and is lifted and lowered vertically together with the latter. The platform is composed of a primary part, i.e. the actual supporting construction designed for the ship loads and a secondary part, i.e. a platform cover which is designed for the usual moving loads. The platform lifts are adapted to the respective carrying loads of the lifting installation, but are identical with respect to the construction principle, so that a genuine building block principle is also provided in this case. For the lower range of lifting installation construction series of 15 to 80 t carrying power, the platform can be advantageously outfitted for travel on rubber-tired ship trailers. Travel with track-bound transport cars is preferred for the middle and upper range of the construction series, i.e. carrying powers of 500 t. It is also possible to combine the two systems in one and the same platform.

Accordingly, different transporting systems can be provided for transporting the ships for repair purposes, maintenance, new construction or winter storage within the work areas arranged for these purposes or from the work area to the platform of the lifting installation. The requirements of the shipyard, marina or yacht club govern the decision as to which system is used. The demands of a marina are different from those of a shipbuilding or repair yard.

The following two transport systems are substantially preferred:

1. Rubber-tired ship trailer with an integrated lifting device for lifting and lowering the docked ships. These trailers are very maneuverable and can occupy any desired position in the dock ground; they are preferably used for smaller lifting installations of 15 to 80 t.

2. Track-bound transport cars outfitted with rotatable sets of wheels. Of course, the maneuverability of these transport cars is limited compared with the alternative mentioned above, since they are rail-bound. Transport cars are very suitable especially for yards with fixed dock spaces.

For quick repairs, the ship can also remain on the platform.

A portable hand control device for the lifting mechanisms can preferably be provided as an alternative to a hand control device arranged at a swivel arm of a lifting mechanism. In this way, an on-site control can be achieved directly at the location of activity where the lifting process takes place; the hand control device is connected with a central control unit in which all lifting mechanisms are interconnected and which is arranged e.g. on the pier directly adjacent to the platform. A stored-program control unit can be used, which automatically monitors all functions of the lifting installation and always shuts down the installation during defective operation, operating errors or by activation of monitoring or safety devices. Operation itself is extremely simple and is limited chiefly to the following functions "LIFT", "LOWER", "STOP" and "EMERGENCY SHUTDOWN". If only four lifting mechanisms are always used for the lifting installations of all construction sizes, the electrical control and operation is fundamentally identical for all lifting installations.

It is suggested that a ship centering and supporting device - preferably outfitted with a scissor-type lifting table - be arranged on the platform. Two scissor-type lifting tables are located at each side of the platform, which scissor-type lifting tables are advantageously provided with bumpers, i.e. comprise coaming supports cushioned with rubber buffers, and can be adjusted to the respective width of the ship in a continuous manner and serve to stabilize the docked ship. The ship can be docked by any person entrusted with the operation of a ship. It is comparable to a standard landing maneuver. The correct position of a ship in the center line of the platform is achieved automatically by the coaming supports provided with bumpers. The special advantage to this consists in that the ship is always docked on the keel. There is no risk of damage to the ship surface, depth sounding, rudder, propeller or other part of the ship lying under water, as can occur in systems working with belts.

If the platform is covered with a steel plate - instead of with wooden planks - and provided with dirty water gutters, this results so-to-speak in a service station for ships directly on the platform; this is a great advantage since it is no longer necessary to transport the ship to repair and/or maintenance areas on land. The water resulting during the cleaning of the ship which is possibly charged with harmful substances (oil, paint, etc.) is collected via the gutters and guided to a central disposal.

BRIEF DESCRIPTION OF THE DRAWINGS

The invention is explained in more detail in the following with reference to embodiment examples shown in the drawings.

DETAILED DESCRIPTION OF THE PREFERRED EMBODIMENT

Figure 1:
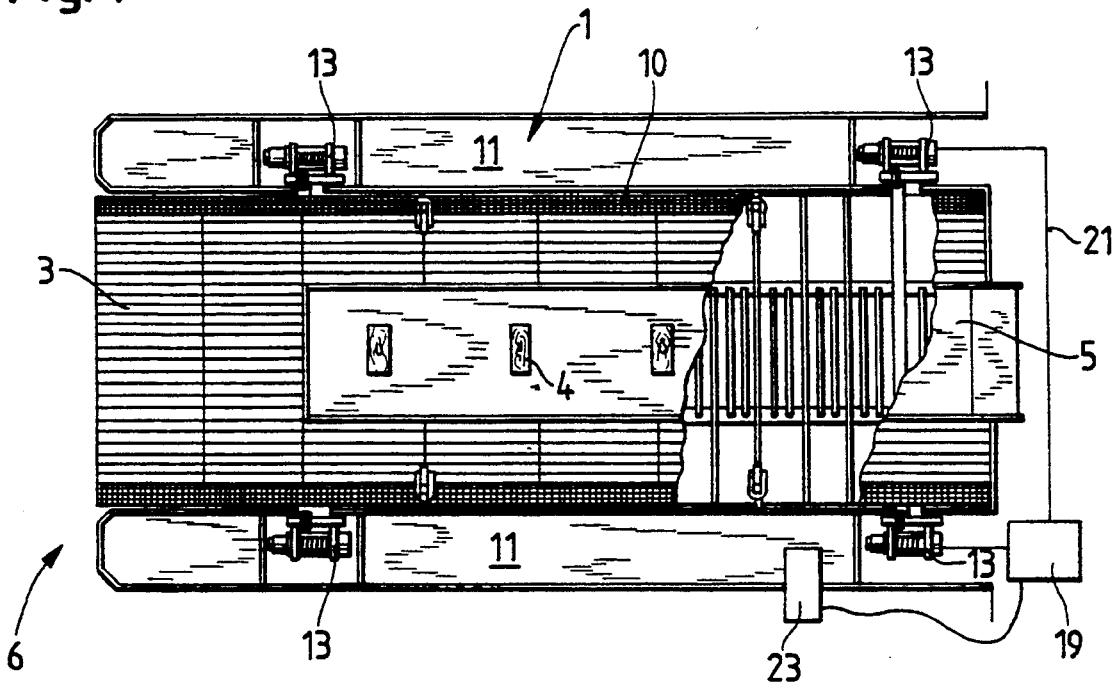
FIG. 1 is a view of a ship lifting installation, according to the invention, from the top.

The invention will be better understood by the Detailed Description of the Preferred Drawings, in connection with the invention, of which FIG. 1 is a top view of a ship lifting installation 1 for docking ships 2 (see FIGS. 2 and 3), which is arranged on a pier comprising a platform 3 which is covered either with wooden planks or with a steel plate and comprises an integrated transporting system constructed as a shunting or transporting path 5; moreover, the shunting path 5 is provided with keel blocks 4 for the ship 2. In a platform 3, provided with a steel plate covering, there are gutters 10 for collecting dirty water. Two lifting mechanisms 13 are fastened, via cross-pieces 12 (see FIG. 2) and lifting mechanism frames 25 (see FIGS 5 and 6), so as to be flush with one another along both longitudinal sides of the platform 3 on the foundation 11 (pier) of the ship lifting installation 1. The foundation 11 is anchored via piles 7 in the floor 8 of a water basin 9. The lifting mechanisms 13 are outfitted with an upper and lower cable pulley block 14, 15. A cable 17 runs over the blocks 14, 15 and over a grooved surface of a cable drum 16 (see FIGS. 4 and 6). The cable 17 is wound in one layer around the cable drum 16 (compare FIGS. 4 and 6). The lower pulley block 15 is provided with axles 18 on which the platform 3 is secured (compare FIG. 2) and the upper cable pulley block 14 is arranged separately from the cable drum 16 (see FIG. 5) on a cable pulley support 20.

Figure 2:
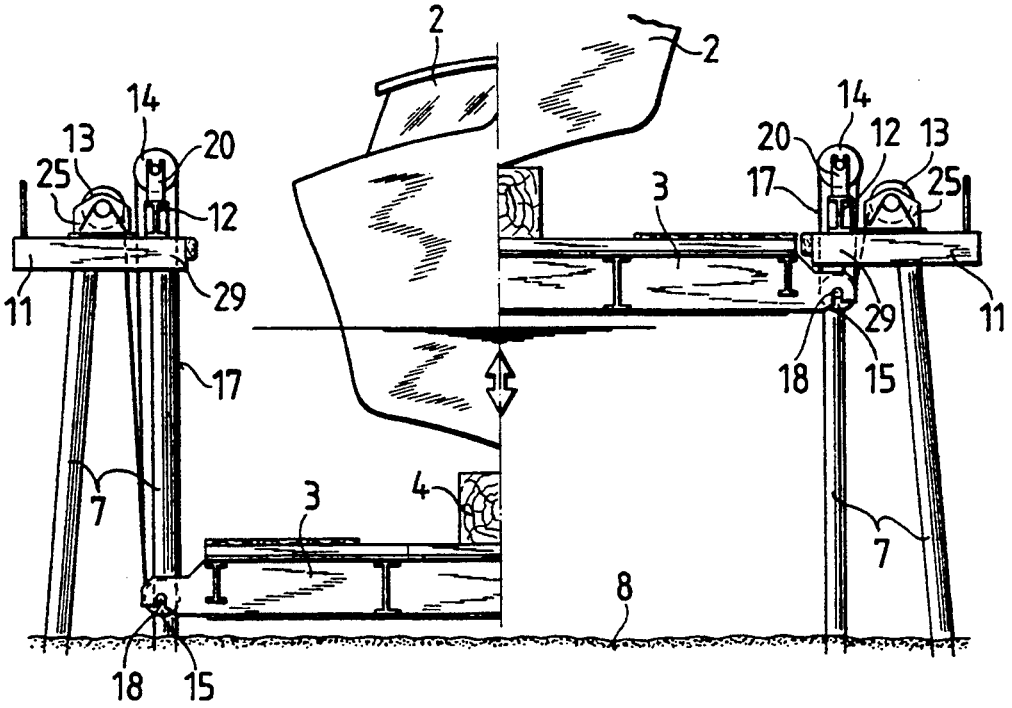
FIG. 2 shows a cross section of the ship lifting installation according to FIG. 1, the platform is shown in the lifted position in the left half.

The lifting mechanisms 13 are centrally actuated by a mobile portable hand control device 23 in order to lift and lower the ship 2, e.g. from the water position shown in the left half of FIG. 2 into the raised position shown in the right half of FIG. 2. This portable hand control device 23, which is electrically connected with the central control unit 19, as is indicated schematically in FIG. 1 by the control lines 21, can always be used from the most favorable observation point because of its portable construction.

Figure 5:
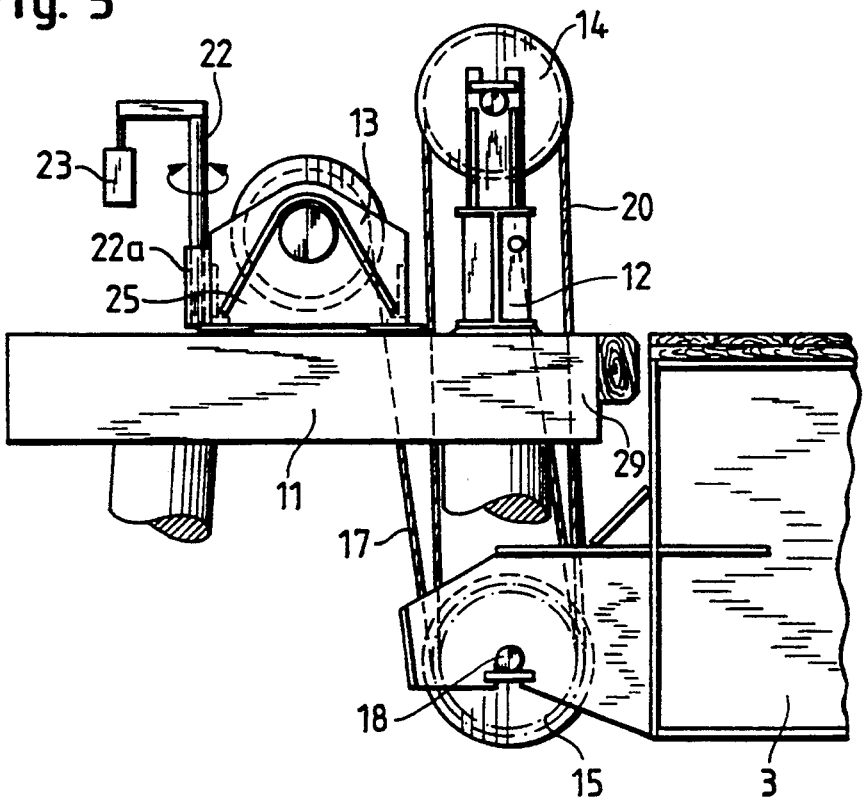
FIG. 5 is a side view of the lifting mechanism according to FIG. 4.

According to another construction, shown schematically in FIG. 5, a hand control device 23, which is arranged so as to swing freely with a swivel arm 22, is located directly at a lifting mechanism 13. The swivel arm 22 is supported for rotation about its axis in a pivot bearing 22*a*. Central control processes are also carried out in this case via the hand control device 23.

Figure 3:
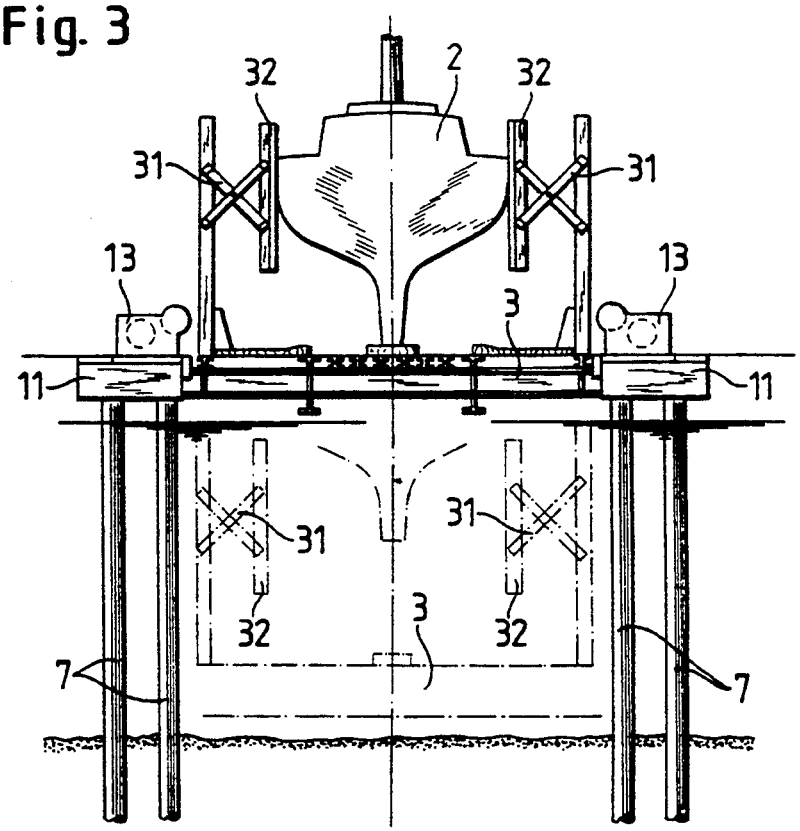
FIG. 3 is a front view of a platform of a ship lifting installation outfitted with scissor-type lifting tables.

In the construction according to FIG. 3, the platform 3 comprises two ship centering and supporting devices 30, at each longitudinal side, which are adjustable in a continuous manner; these ship centering and supporting devices 30 are constructed as scissor-type lifting tables 31 with (rubber-cushioned) coaming supports 32 provided with bumpers. To dock, the ship 2 is lifted uniformly and synchronously via the lowered platform 3, shown in dash-dot lines, via the electronic lifting mechanisms 13 until the ship 2 stands with its keel on the platform 3. The ship 2 is then brought to the center line of the platform 3 by the coaming supports 32, which are adjustable in a continuous manner by means of the scissor-type lifting tables 31 and held in this position. The fully raised position of the ship 2 is shown by solid lines in FIG. 3; repair or maintenance can now be performed on the ship 2 on the platform 3 itself. Alternatively, the ship 2 can also be moved from the platform 3 with the described transporting system.

Figure 4:
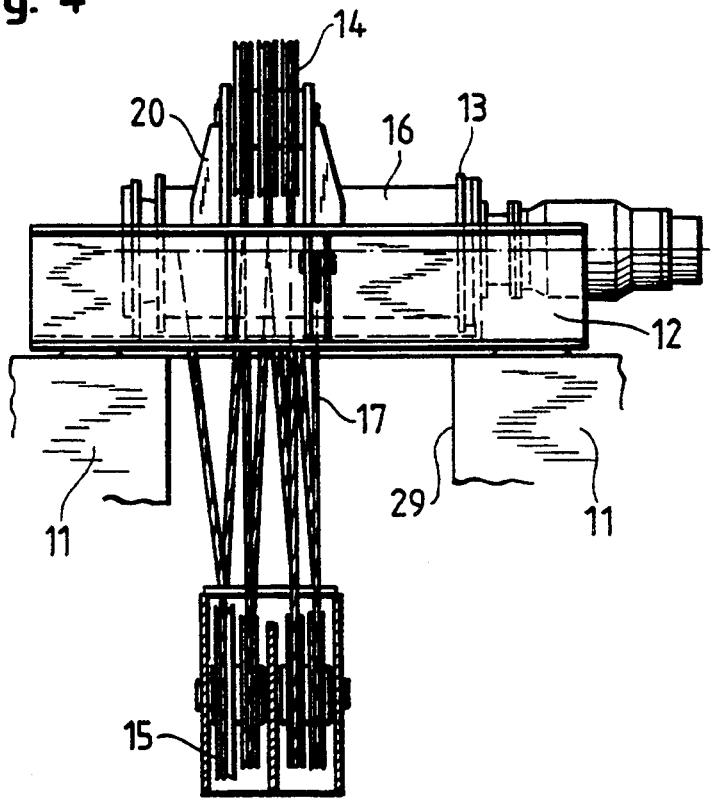
FIG. 4 is a view alongside a mass-production lifting mechanism used for the ship installation according to FIG. 1.
Figure 6:
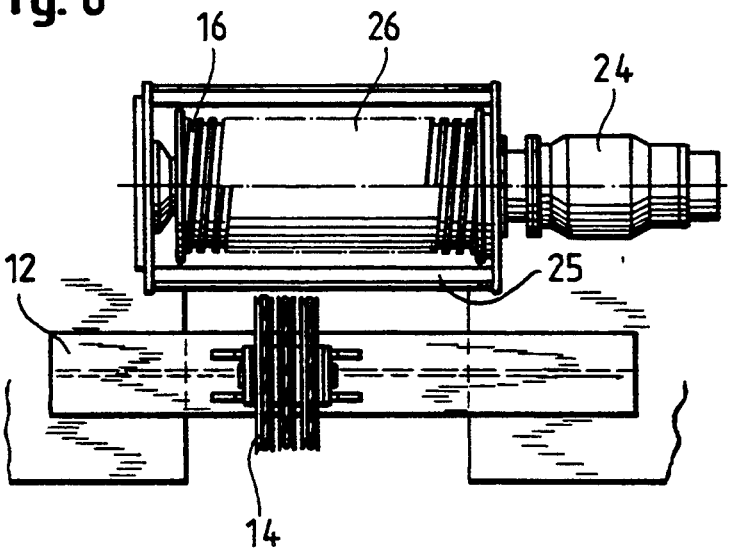
FIG. 6 is a top view of the lifting mechanism according to FIG. 4 with the space requirement of a known comparable hoist shown in dash-dot lines for the sake of comparison.
Figure 7:
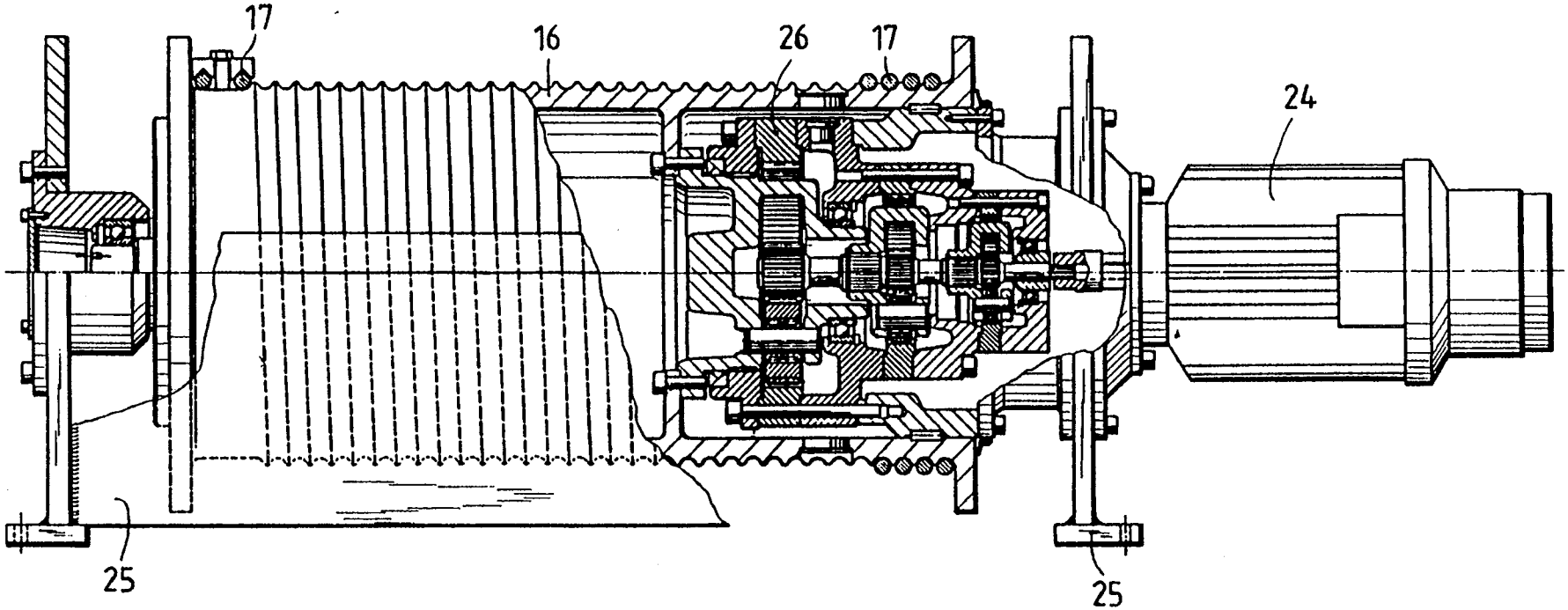
FIG. 7 is a cut-out, cross-sectional view of the planetary gear train.

As can be seen from FIGS. 4 to 6, the lifting mechanism 13 constitutes an extremely compact, very narrow part in which an electrical mass-production brake motor 24 is flanged on at the cable drum 16 and a planetary gear unit 26 is integrated in the cable drum 16 - as indicated in FIG. 6 by reference number 26. The planetary gear unit 26 is shown in FIG. 7. The planetary gear unit 26 is a conventional planetary gear unit. Each of the four lifting mechanisms 13, (compare FIG. 1) is arranged in a lifting mechanism frame 25 and passes into a recess 29 (compare FIG. 4) in the foundation 11, with its lower cable pulley block 15 and the cable 17 guided around the latter. The space requirement for a lifting mechanism 13, which is very low compared to a known hoist because of the compact construction, is illustrated in FIG. 6, which shows the space requirement for a comparable hoist in a schematic manner as a dash-dot frame. Accordingly, in addition to all of the other described advantages of the lifting mechanisms 13, the foundation 11 is substantially narrower and the pier can be constructed so as to be correspondingly narrower. While the preferred embodiments of the invention have been, various modifications and adaptations may be made thereto, without departing from the spirit and scope of the invention, as delineated in the following claims:

We claim:

1. A ship lifting installation, comprising:

a platform for docking ships and having opposite longitudinal sides; and at least two lifting mechanisms arranged, at said opposite sides, respectively, for lifting and lowering said platform;

wherein each of the lifting mechanisms comprises:

a grooved cable drum including a planetary gear unit located in the cable drum for rotating the same;

at least one upper pulley block arranged separately from said cable drum on a cable pulley support;

at least one lower pulley block fixedly connected with said platform;

a cable extending about said upper and lower pulley blocks and said cable drum; and a standard electric motor with an integrated brake for driving said planetary gear unit in opposite direction to rotate said cable drum in the opposite directions to wind and unwind, respectively, said cable on and from said cable drum thereby to lift and to lower said lower pulley block together with said platform.

2. The ship lifting installation of claim 1, further comprising lifting mechanism frames for supporting said lifting mechanisms, respectively, and anchorable in a pier foundation.

3. The ship lifting installation of claim 1, further comprising a central portable hand control device for controlling said lifting mechanisms.

4. The ship lifting installation of claim 3, wherein one of said lifting mechanisms has a swivel arm, said hand control device being supported on said swivel arm.

5. The ship lifting mechanism of claim 1, wherein said platform comprises an integrated transporting system.

6. The ship lifting installation of claim 1, wherein said lower blocks have each an axle, said platform being secured on said axles.

7. The ship lifting installation of claim 1, further comprising ship centering and supporting means provided on said platform.

8. The ship lifting installation of claim 7, wherein said ship centering and supporting means comprises scissor-type lifting table means.

9. The ship lifting installation of claim 8, wherein said scissor-type lifting table means comprises claiming support means outfitted with bumper means.

10. The ship lifting installation of claim 1, wherein said platform is covered with a steel plate and has dirty water gutters.

* * * * *